US008950597B2

(12) United States Patent
Lin

(10) Patent No.: US 8,950,597 B2
(45) Date of Patent: Feb. 10, 2015

(54) TOOL MOUNT ASSEMBLY

(76) Inventor: Tsung-Ming Lin, Taichung (TW)

( * ) Notice: Subject to any disclaimer, the term of this patent is extended or adjusted under 35 U.S.C. 154(b) by 248 days.

(21) Appl. No.: 13/411,676

(22) Filed: Mar. 5, 2012

(65) Prior Publication Data

US 2013/0228539 A1 Sep. 5, 2013

(51) Int. Cl.
*A47F 7/00* (2006.01)
*B65D 85/28* (2006.01)

(52) U.S. Cl.
USPC ..... 211/70.6; 206/376; 206/377

(58) Field of Classification Search
CPC ..... B25H 3/003; B25H 3/04; B25H 3/025; B25H 3/023; B25B 13/56; B25B 15/008
USPC ..... 211/69, 70.6, 69.5; 206/45.23, 349, 206/234, 372–379
See application file for complete search history.

(56) References Cited

U.S. PATENT DOCUMENTS 1,973,188 A * 9/1934 Verderber ..... 211/70.6
2,510,260 A * 6/1950 Searfoss ..... 206/377
2,590,307 A * 3/1952 Gibson ..... 206/377
2,701,052 A * 2/1955 Martel ..... 206/377
2,776,744 A * 1/1957 Cook ..... 206/377
2,833,419 A * 5/1958 Trumpy ..... 211/70.6
3,997,053 A * 12/1976 Bondhus ..... 206/377
5,248,030 A * 9/1993 Tarozzi ..... 206/1.7
5,512,165 A * 4/1996 Liu ..... 206/234
5,816,401 A * 10/1998 Vasudeva et al. ..... 206/377
5,938,028 A * 8/1999 Hu ..... 206/377
6,032,796 A * 3/2000 Hopper et al. ..... 206/377
6,053,316 A * 4/2000 Lo ..... 206/379
D436,436 S * 1/2001 Lin ..... D3/228
D461,311 S * 8/2002 Gharib ..... D3/315
6,832,684 B2 * 12/2004 Huang ..... 206/376
6,988,616 B2 * 1/2006 Chen ..... 206/379
D548,464 S * 8/2007 Lin ..... D3/315
D549,453 S * 8/2007 Chang ..... D3/303
7,870,956 B1 * 1/2011 Wang ..... 206/373
7,938,261 B1 * 5/2011 Lee ..... 206/376
8,276,767 B2 * 10/2012 Su ..... 211/70.6
D672,139 S * 12/2012 Liu ..... D3/228
2001/0010291 A1 * 8/2001 Hu ..... 206/377
2007/0023306 A1 * 2/2007 Lai ..... 206/372
2007/0235360 A1 * 10/2007 Lin ..... 206/373
2008/0053853 A1 * 3/2008 Kao ..... 206/377
2008/0164171 A1 * 7/2008 Meng ..... 206/377
2008/0202963 A1 * 8/2008 Liao ..... 206/377
2008/0251402 A1 * 10/2008 Chiu ..... 206/377
2010/0065522 A1 * 3/2010 Cheng ..... 211/85.8
2011/0226713 A1 * 9/2011 Su ..... 211/70.6
2012/0012485 A1 * 1/2012 Wang ..... 206/377
2013/0228539 A1 * 9/2013 Lin ..... 211/70.6
2013/0277258 A1 * 10/2013 Lai ..... 206/377
2013/0306508 A1 * 11/2013 Gallegos ..... 206/377

* cited by examiner

*Primary Examiner* — Patrick Hawn
(74) *Attorney, Agent, or Firm* — Rosenberg, Klein & Lee

(57) ABSTRACT

A tool mount assembly has a mount and a first cover. The mount has a placing surface and multiple linear tool grooves formed in the placing surface. The first cover is pivotally connected with the mount and covers the placing surface to close the tool grooves.

3 Claims, 9 Drawing Sheets

TOOL MOUNT ASSEMBLY

BACKGROUND OF THE INVENTION

1. Field of the Invention

The present invention relates to a tool mount assembly, and more particularly to a tool mount assembly allowing tools to be easily placed or taken.

2. Description of Related Art

A conventional tool mount is a plastic chunk and has multiple linear tool holes. The tool holes are formed through the tool mount and allow tools, such as hexagonal wrenches, to be inserted into or pulled out from the tool holes.

However, the diameters of the tool holes are not precise due to tolerance problems in manufacturing processes of the tool mount. The diameters of the tool holes may be smaller than those of the corresponding tools and the tools are difficultly inserted into or pulled out from the conventional tool holes.

Moreover, frequent pulling or inserting the tools wears and enlarges the tool holes, so the tools easily fall from the tool holes to cause inconvenience in use.

To overcome the shortcomings, the present invention tends to provide a tool mount assembly to mitigate the aforementioned problems.

SUMMARY OF THE INVENTION

The main objective of the invention is to provide a tool mount assembly allowing tools to be easily placed or taken.

A tool mount assembly has a mount and a first cover. The mount has a placing surface and multiple linear tool grooves formed in the placing surface. The first cover is pivotally connected with the mount and covers the placing surface to close the tool grooves. When the first cover is pivoted, tools, such as hexagonal wrenches, are easily and conveniently placed in or taken out from the tool grooves. This is convenient in use.

Other objects, advantages and novel features of the invention will become more apparent from the following detailed description when taken in conjunction with the accompanying drawings.

DETAILED DESCRIPTION OF PREFERRED EMBODIMENT

Figure 1:
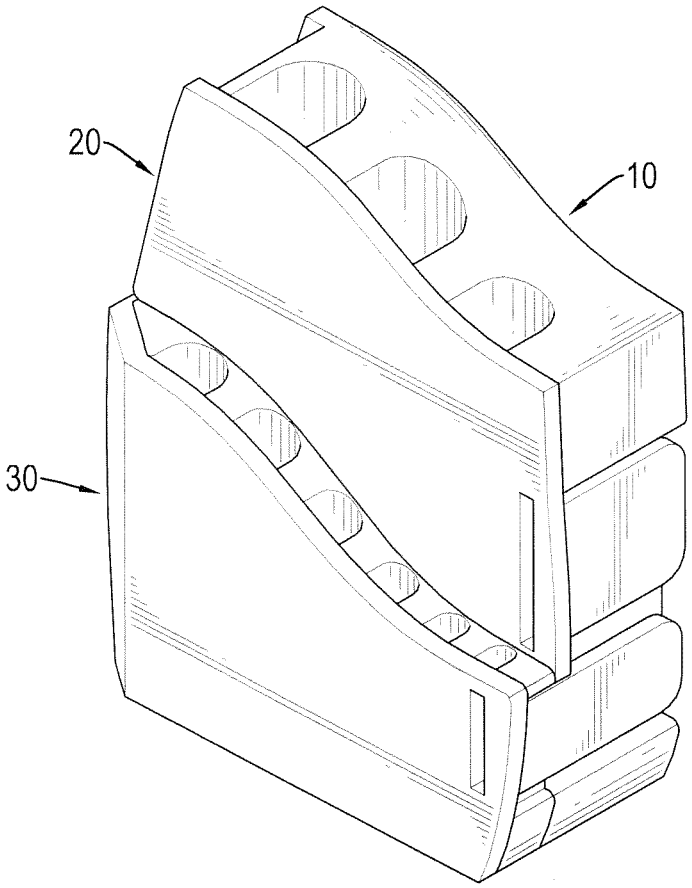
FIG. 1 is a front perspective view of a first embodiment of a tool mount assembly in accordance with the present invention.
Figure 2:
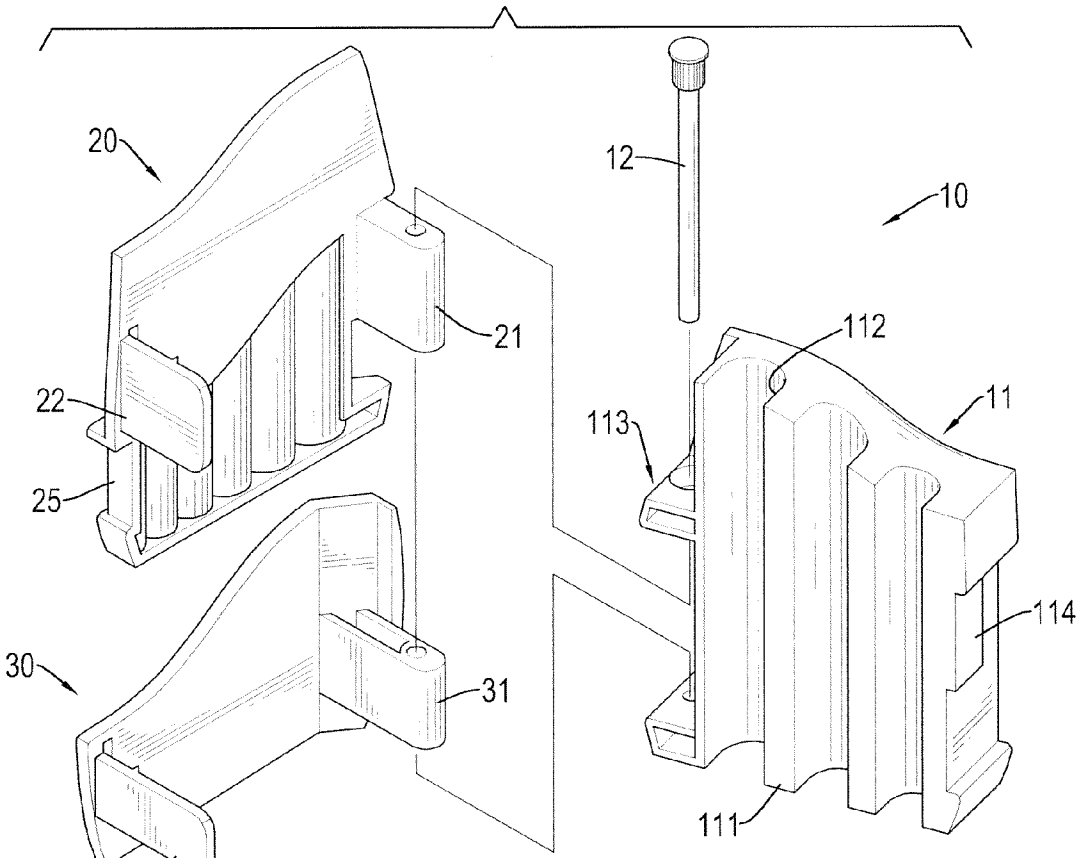
FIG. 2 is an exploded perspective view of the tool mount assembly in FIG. 1.
Figure 3:
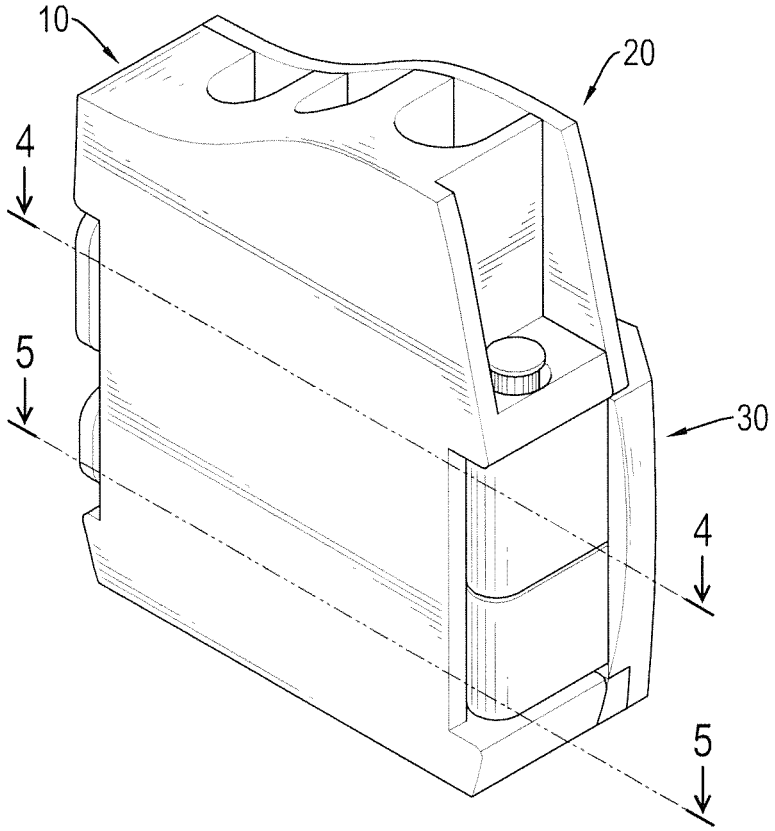
FIG. 3 is a rear perspective view of the tool mount assembly in FIG. 1.

With reference to FIGS. 1 to 3, a first embodiment of a tool mount assembly in accordance with the present invention comprises a mount 10, a first cover 20 and a second cover 30.

The mount 10 has a main body 11 and a pivot 12. The main body 11 is a plastic chunk and has two opposite end surfaces, two opposite side surfaces, a placing surface 111, multiple tool grooves 112, a connecting section 113 and a protrusion 114. The tool grooves 112 are linear, are formed in the placing surface 111 and are parallel to each other. Each tool groove 112 has two opposite ends. The ends of each tool groove 112 are respectively formed through the end surfaces of the mount 10. The connecting section 113 and the protrusion 114 respectively protrude out from the side surfaces of the main body 11. The connecting section 113 has two lumps. The pivot 12 is rotatably mounted through one of the lumps and is rotatably mounted in the other of the lumps.

Figure 4:
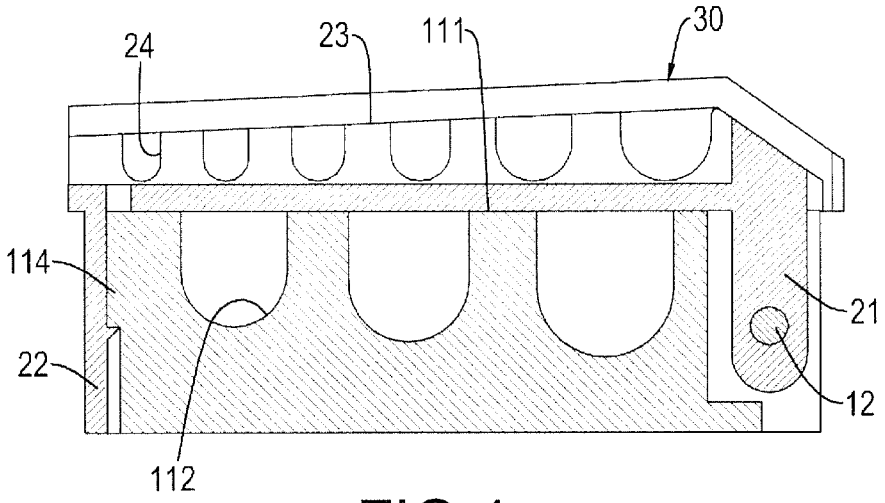
FIG. 4 is an enlarged cross sectional top view of the tool mount assembly along a line 4-4 in FIG. 3.
Figure 6:
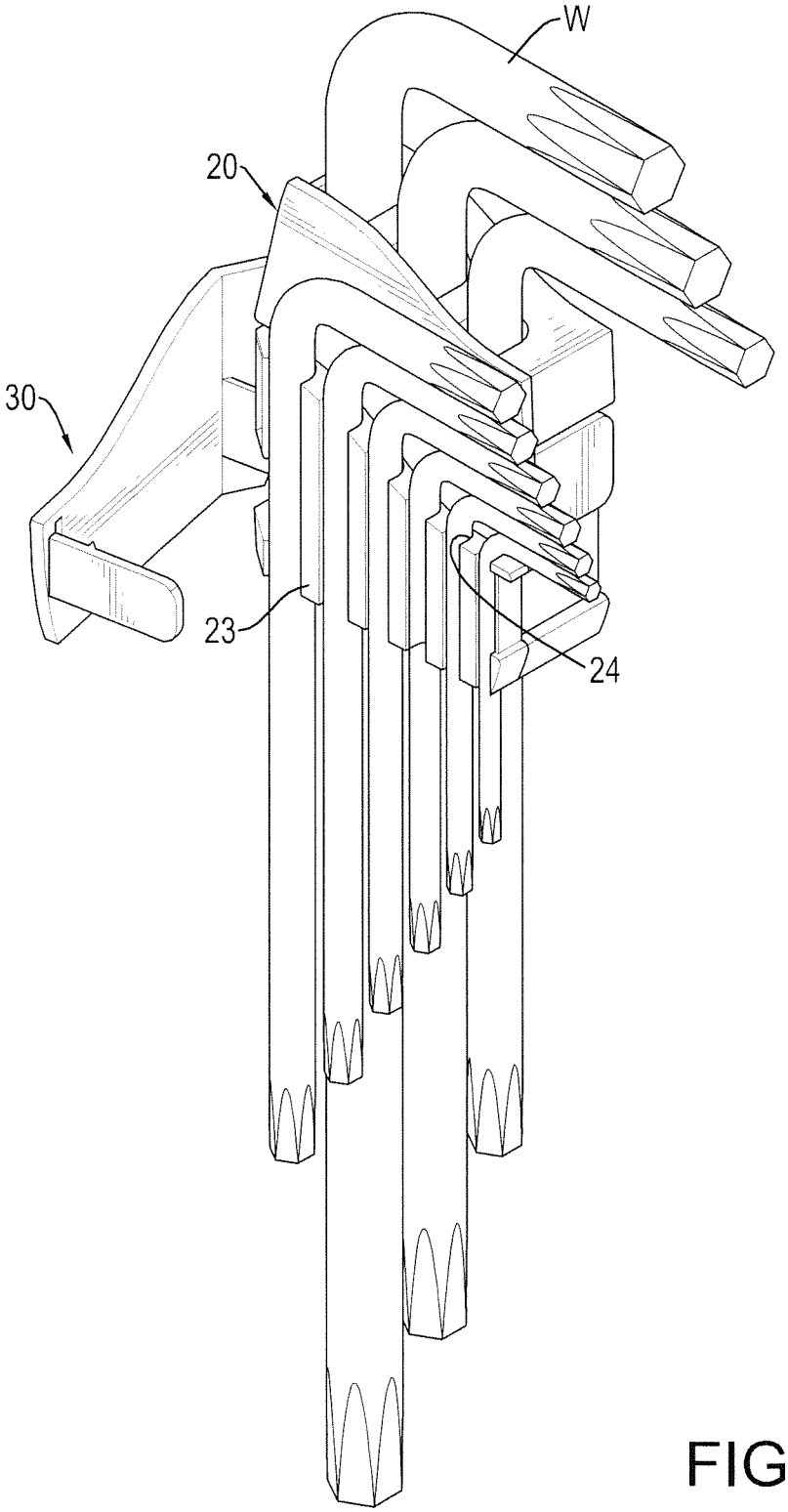
FIG. 6 is an operational perspective view of the tool mount assembly in FIG. 1.

With reference to FIGS. 2, 4 and 6, the first cover 20 is pivotally connected with the mount 10, covers the placing surface 111 to close the tool grooves 112 and has a pivoted section 21 and a hooking section 22. The pivoted section 21 is formed on a side edge of the first cover 20 and is located between the lumps. The pivoted section 21 is mounted around the pivot 12 to be pivotally connected with the mount 10. The hooking section 22 is formed on and protrudes from the first cover 20 at a side edge opposite to the side edge on which the pivoted section 21 is formed. The hooking section 22 is detachably and securely connected with the protrusion 114 of the mount 10.

Preferably, the first cover 20 has two opposite end surfaces, a connecting surface 23 and multiple connecting grooves 24. The connecting surface 23 is opposite to a side surface of the first cover 20 that faces the tool grooves 112. The connecting grooves 24 are linear, are formed in the connecting surface 23 and are parallel to the tool grooves 112. Each connecting groove 24 has two opposite ends respectively formed through the end surfaces of the first cover 20.

The first cover 20 has a recess 25 formed in the first cover 20 and adjacent to the hooking section 22.

Figure 5:
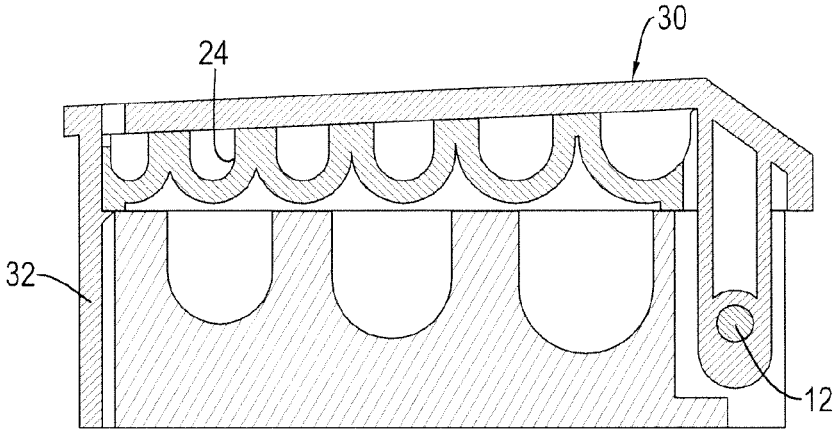
FIG. 5 is an enlarged cross sectional top view of the tool mount assembly along a line 5-5 in FIG. 3.

With reference to FIGS. 2 and 5, the second cover 30 is pivotally connected with the mount 10, covers the first cover 20 to close the connecting grooves 24 and has a pivoted section 31 and a hooking section 32. The pivoted section 31 is formed on a side edge of the second cover 30 and is located between the lumps and below the pivoted section 21 of the first cover 20. The pivoted section 31 of the second cover 30 is mounted around the pivot 12 to be pivotally connected with the mount 10. The hooking section 32 of the second cover 30 is formed on and protrudes from the second cover 30 at a side edge opposite to the side edge on which the pivoted section 31 of the second cover 30 is formed. The hooking section 32 of the second cover 30 is detachably and securely connected with the recess 25 of the first cover 20.

With reference to FIG. 6, the first cover 20 and the second cover 30 are pivoted to make the tool grooves 112 and the connecting grooves 24 open. Accordingly, multiple hexagonal wrenches W of different sizes are respectively placed in the tool grooves 112 and the connecting grooves 24. With the first cover 20 and the second cover 30 being opened, the hexagonal wrenches W are easily and conveniently placed into or taken out from the tool grooves 112 and the connecting grooves 24.

Figure 7:
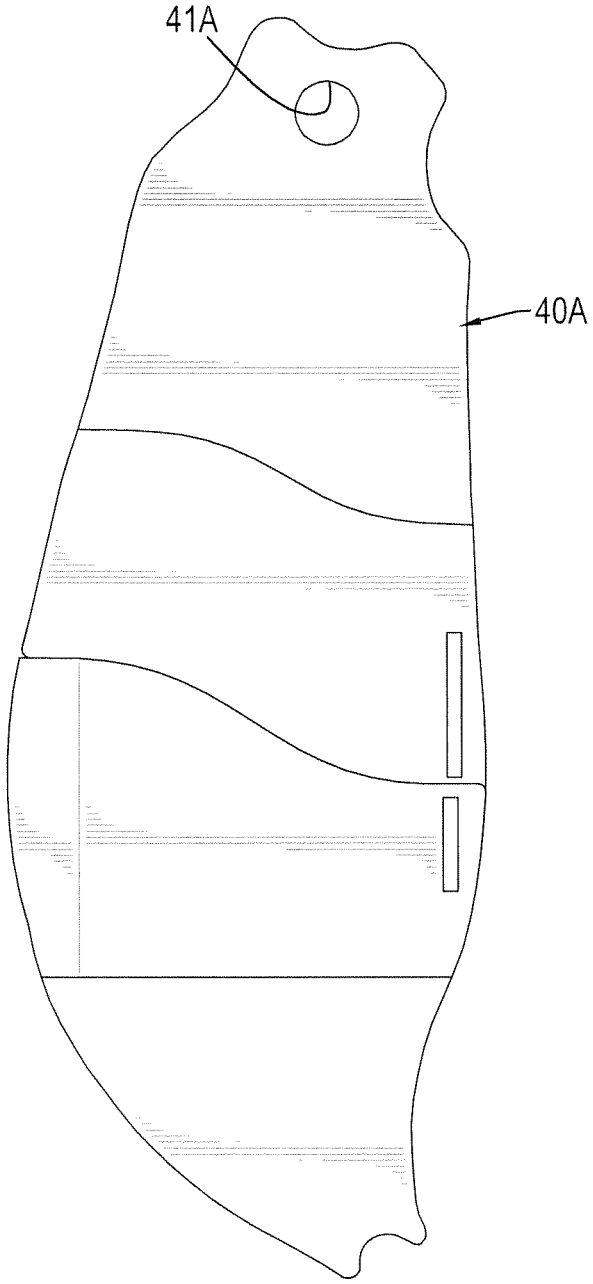
FIG. 7 is a front view of a second embodiment of a tool mount assembly in accordance with the present invention.
Figure 8:
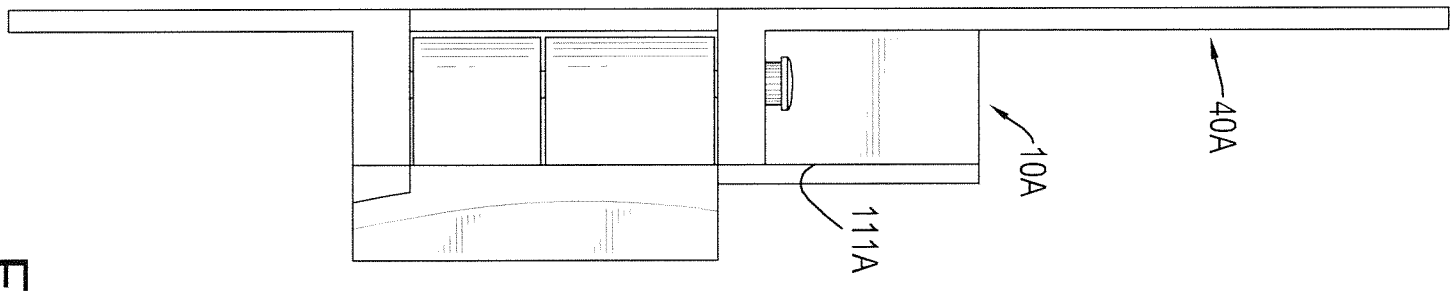
FIG. 8 is a side view of the tool mount assembly in FIG. 7.

With reference to FIGS. 7 and 8, a second embodiment of the tool mount assembly is substantially the same as the first embodiment. The tool mount assembly further has a hanging plate 40A. The hanging plate 40A is mounted securely on the mount 10A, is opposite to the placing surface 111A and has a hanging hole 41A formed through the hanging plate 40A. Accordingly, the second embodiment can be hung on a wall or other objects.

Figure 9:
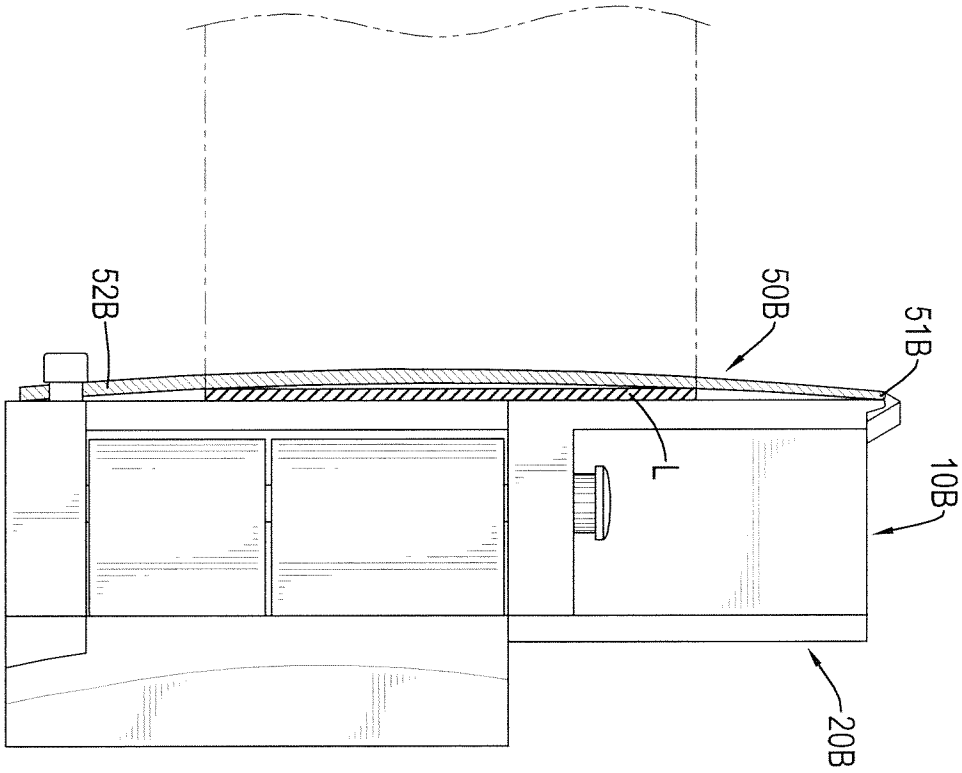
FIG. 9 is an operational side view in partial section of a third embodiment of a tool mount assembly in accordance with the present invention.

With reference to FIG. 9, a third embodiment of the tool mount assembly is substantially the same as the first embodiment. The tool mount assembly further has a fastening plate 50B. The fastening plate 50B is mounted securely on the mount 10B, is opposite to the placing surface 111 and has a bent section 51B and a fastening section 52B. The bent section 51B is integrally connected with the mount 10B. The fastening section 52B is opposite to the bent section 51B and is detachably and securely connected with the mount 10B. Accordingly, a gap is formed between the fastening plate 50B and the mount 10B and allows a belt L to be inserted through the gap. Consequently, the third embodiment can be worn by a user.

From the above description, it is noted that the present invention has the following advantages:

1. Easy Placing and Taking:

When the first cover 20,20B or the second cover 30 is pivoted to open, the hexagonal wrenches W are easily and conveniently placed into or taken out from the corresponding grooves 112,24, instead of being frequently inserted into or pulled from the tool grooves 112 and the connecting grooves 24.

2. Prevention of Wear:

Because the hexagonal wrenches W are prevented from being frequently inserted into and pulled from the tool grooves 112 and the connecting grooves 24, the tool grooves 112 and the connecting grooves 24 are effectively prevented from being worn.

3. Easy Hanging and Carrying:

With the hanging hole 41A and the fastening plate 50B, the tool mount assembly in accordance with the present invention can be hung or worn and this is greatly convenient in hanging or carrying.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool mount assembly comprising: a mount having two opposite end surfaces; a placing surface; and multiple linear tool grooves being parallel to each other, each tool groove having two opposite ends respectively formed through the end surfaces of the mount; and a groove opening formed in the placing surface; and a first cover pivotally connected with the mount, covering the placing surface to close the groove openings of the tool grooves and having a pivoted section formed on a first side edge of the first cover and pivotally connected with the mount; and a first hooking section formed on and protruding from the first cover at a second side edge opposite to the first side edge, wherein the hooking section is detachably and securely connected with the mount; the first cover further having two opposite end surfaces; a connecting surface opposite to a side surface of the first cover that faces the tool grooves; and multiple linear connecting grooves formed in the connecting surface and being parallel to the tool grooves, each connecting groove having two opposite ends respectively formed through the end surfaces of the first cover; and the tool mount further has a second cover pivotally connected with the mount, covering the first cover to close the connecting grooves and having a second pivoted section formed on a first side edge of the second cover and pivotally connected with the mount; and a second hooking section formed on and protruding from the second cover at a second side edge opposite to the first side edge on which the second pivoted section of the second cover is formed, wherein the second hooking section of the second cover is detachably and securely connected with the first cover; the first hooking section and the second hooking section being disposed adjacent one to the other when the first and second covers are in a closed position with respect to the mount.

2. The tool mount assembly as claimed in claim 1, wherein the tool mount assembly further has a hanging plate mounted securely on the mount, opposite to the placing surface and having a hanging hole formed through the hanging plate.

3. The tool mount assembly as claimed in claim 1, wherein the tool mount assembly further has a fastening plate mounted securely on the mount, opposite to the placing surface and having a bent section integrally connected with the mount; and a fastening section opposite to the bent section and detachably and securely connected with the mount.

* * * * *